United States Patent [19]

Hooft van Huijsduijnen

[11] Patent Number: 4,516,051

[45] Date of Patent: May 7, 1985

[54] CATHODE-RAY TUBE AND CATHODE UNIT FOR SUCH A CATHODE-RAY TUBE

[75] Inventor: Jozef A. M. Hooft van Huijsduijnen, Eindhoven, Netherlands

[73] Assignee: U.S. Philips Corporation, New York, N.Y.

[21] Appl. No.: 435,144

[22] Filed: Oct. 18, 1982

[30] Foreign Application Priority Data

Nov. 18, 1981 [NL] Netherlands ..... 8105222

[51] Int. Cl.[3] ..... H01J 29/48; H01J 19/48

[52] U.S. Cl. ..... 313/446; 313/270; 313/337

[58] Field of Search ..... 313/446, 337, 338, 270

[56] References Cited

U.S. PATENT DOCUMENTS 3,354,340 11/1967 Almer et al. ..... 313/270 X 4,403,169 9/1983 Blanken ..... 313/446

*Primary Examiner*—Palmer Demeo

*Attorney, Agent, or Firm*—Robert J. Kraus

[57] ABSTRACT

A cathode filament formed from a thin metal wire wound into a helical spiral is welded at its two ends to connection braces by means of a high energy beam such as a laser beam. By increasing the pitch of at least one of the turns near each of the two ends, welding is confined to a predefined number of turns and uniformly welded cathodes are obtained having filament resistances which differ by less than 1%.

5 Claims, 6 Drawing Figures

CATHODE-RAY TUBE AND CATHODE UNIT FOR SUCH A CATHODE-RAY TUBE

BACKGROUND OF THE INVENTION

The invention relates to a cathode-ray tube comprising in an evacuated envelope an electron gun for generating an electron beam, which electron gun has a cathode unit comprising a cup-shaped cathode shaft and a cathode filament disposed therein, comprising a thin metal wire wound in the form of a first helical spiral, which is folded or wound into a second spiral and is covered with insulation material, the ends of the first spiral being welded to connection braces.

The invention also relates to a cathode unit for such a cathode-ray tube.

Such cathode-ray tubes have a very wide field of application and are used, for example, as television camera tubes, television display tubes, oscilloscope tubes, and the like.

Such a cathode-ray tube is described in Netherlands patent application No. 8103814 corresponding to U.S. patent application Ser. No. 401,456 filed July 26, 1982. The filament of the cathode unit described in this patent application is connected by means of laser welding to two connection braces manufactured from flat sheet metal. Laser welding is to be preferred over resistance welding because in resistance welding the filament is touched during the welding process and welding spatters may occur causing short circuits in the tube. However, when laser welding is used during mass production of cathode units it has been found that the resistances of their respective filaments differ considerably. This results in differing heating properties and hence differing emissions of the cathodes.

SUMMARY OF THE INVENTION

It is an object of the invention to provide a cathode-ray tube and a cathode unit in which resistance differences between the respective cathode filaments are minimized.

In accordance with the invention, a cathode-ray tube of the kind mentioned in the opening paragraph is characterized in that at least one of the turns of each of the two ends of the first spiral near the connection braces has a larger pitch than the remaining turns, and the spaces between the turns of the first spiral which are situated between the turn or turns of larger pitch and the ends of the connection braces are filled substantially entirely with the material of the connection braces.

The invention is based on the recognition of the fact that upon welding the spiral-like cathode filament ends to the connection braces, the material of the connection braces melts and as a result of capillary action, the molten material is drawn into the turns of the first spiral. If the molten material is drawn into different numbers of turns in different cathode filaments the above-mentioned resistance differences occur. By using the invention the capillary drawing-in in each cathode filament is restricted to a small predefined part of the cathode filament near the connection brace and up to the turn or turns having the larger pitch. In this manner it is possible to manufacture large numbers of cathode filaments having substantially equal electrical resistances.

The invention is of particular importance in cathode filaments of very small dimensions in which the thickness of the metal wire is approximately 25 μm, the pitch of the first spiral is between 40 and 50 μm and the larger pitch is between 55 and 80 μm.

The turns of each spiral located between the turn or turns of larger pitch and the respective connection brace is entirely filled with the material of the connection brace by melting a sufficient quality of material of the connection brace by means such as a laser beam.

The connection of the cathode filament to the connection braces is preferably done by means of a laser beam, but may also be done by means such as an electron beam, an ion beam or a light beam.

The invention can successfully be used in television camera tubes of very small dimensions, for example, the television camera tube of the type 80-XQ (Philips) operating at a cathode filament power of 0.5 Watt.

BRIEF DESCRIPTION OF THE DRAWING

The invention will now be described in greater detail, by way of example, with reference to the accompanying drawing, in which.

DESCRIPTION OF THE PREFERRED EMBODIMENT

Figure 1:
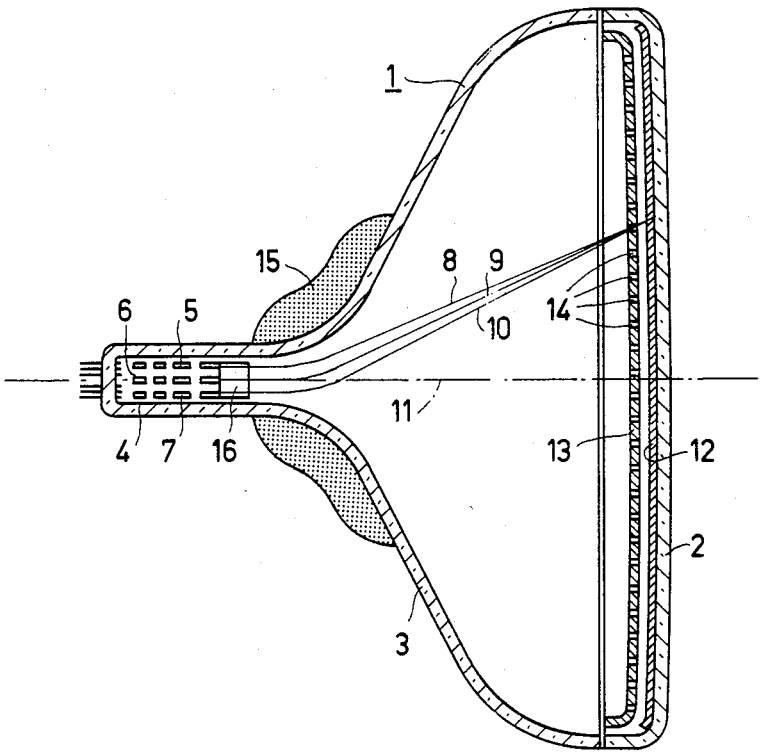
FIG. 1 is a longitudinal sectional view of a colour display tube according to the invention.

FIG. 1 is a longitudinal sectional view of a colour display tube of the "in-line"-type comprising a glass envelope 1, having a display window 2, a funnel-shaped portion 3 and a neck 4, and, in the neck, three electron guns 5, 6 and 7 which generate electron beams 8, 9 and 10, respectively. The axes of the electron guns are situated in the plane of the drawing. The axis of the central electron gun 6 coincides substantially with the tube axis 11. The three electron guns extend into sleeve 16 which is situated coaxially in the neck 4. On its inside the display window 2 has a large number of triplets of phosphor lines. Each triplet comprises a line consisting of a green luminescing phosphor, a line consisting of a blue luminescing phosphor and a line consisting of a red luminescing phosphor. All triplets together constitute the display screen 12. The phosphor lines are normal to the plane of the drawing. A shadow mask 13 positioned in front of the display screen, has a large number of elongate apertures 14 through which the electron beams 8, 9 and 10 pass. The electron beams are deflected over the display screen 12 in the horizontal direction (in the plane of the drawing) and in the vertical direction (normal to the plane of the drawing) by a system of deflection coils 15. The three electron beams are aimed so that their axes each form a small angle with each other. The electron beams pass through the apertures 14 at this angle, known as the colour selection angle, and each beam impinges upon phosphor lines of a respective colour.

Figure 2:
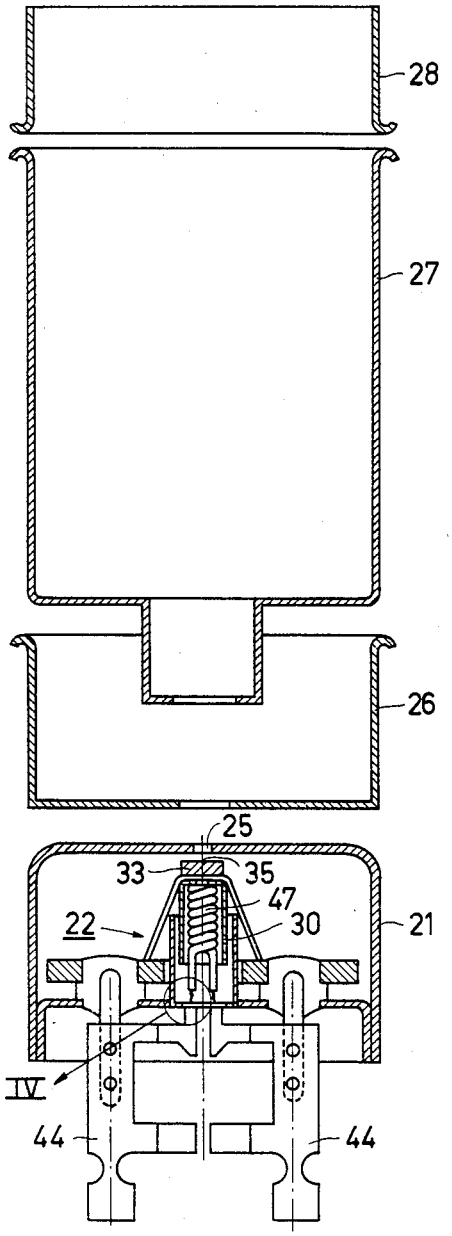
FIG. 2 is a longitudinal sectional view of one of the electron guns of the display tube shown in FIG. 1, FIGS. 3*a* and *b* are a front elevation and a side elevation, respectively, of a prior art connection of the filament, and FIGS. 4*a* and *b* are a front elevation and a side elevation of the connection of the filament according to the invention.

FIG. 2 is a longitudinal sectional view of one of the electron guns. A cathode unit 22, in a control electrode 21 comprises a cathode shaft 30 on which is attached an impregnated tungsten body 33 having an emissive surface 35. The emitted electron beam passes through an aperture 25, in the control electrode 21, which is positioned opposite the emissive surface 35. The beam is then accelerated and focused by means of electrodes 26, 27 and 28. In a typical colour display tube the cathode potential is +30 volts, the control electrode has a fixed potential of 0 volts, the second electrode 26 has a potential of 1,000 volts, the third electrode 27 has a potential of 6,000 volts and the fourth electrode 28 has a potential of 27 kV. Such a cathode unit may also be used in a diode type electron gun (for example, in television camera tubes). In a diode type electron gun the next successive electrode after the cathode is generally an anode which is at a positive potential. A cathode filament 47 which is covered with blackened aluminium oxide is provided in the cathode shaft 30 and is connected to connection braces 44 made of, for example 0.075 mm thick NiFe.

Figure 3A:
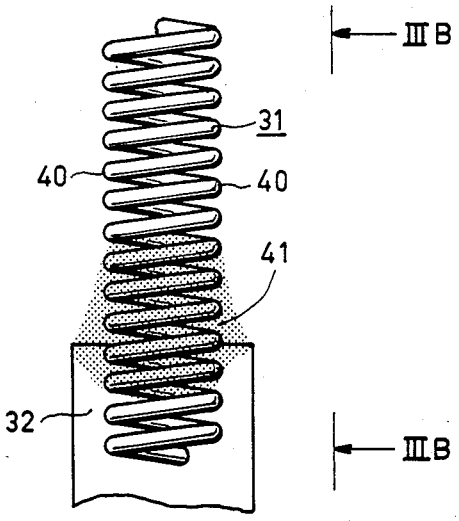
FIG. 3a PRIOR ART
Figure 3B:
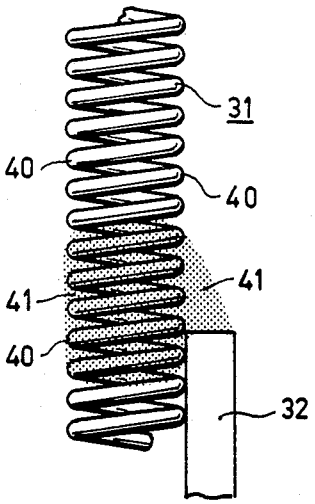
FIG. 3b PRIOR ART

FIGS. 3*a* and 3*b* are front and side elevations showing prior art welding of a cathode filament 31, not yet covered with insulation material, to connection braces 32. By capillary action, the molten material 41 of the connection braces 32 is drawn into the turns 40 of the cathode filament spiral during welding of the spiral to the connection braces. Because of small differences in the spiral shape and the welding process, for different filaments the spaces between the turns of the spiral are filled to differing degrees so that different cathode filaments have resistances which vary up to 2%. Such variations in resistance result in variations in cathode filament currents for identical filament voltages. Such variations are not desired.

Figure 4A:
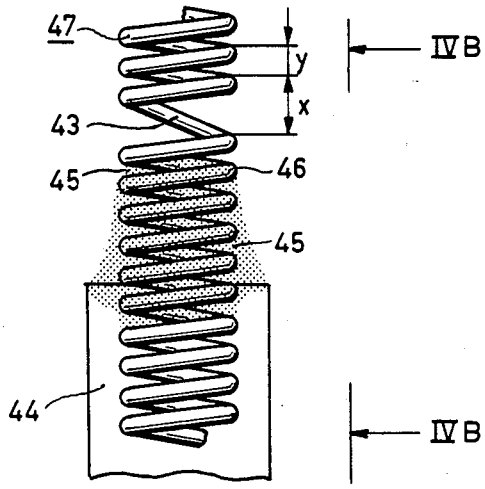
Figure 4B:
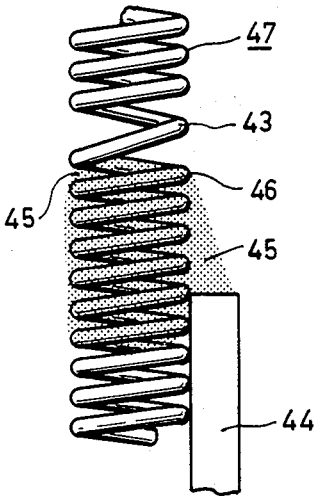

FIGS. 4*a* and 4*b* are front elevations showing, in accordance with the invention, a cathode filament, not yet covered with insulation material, which is provided near the connection braces with a turn 43 having a larger pitch (x) than the pitch (y) of the remaining turns of the spiral. The spaces between the turns 46, which are located between the turn 43 and the connection braces 44, are filled during welding with the molten material 45 of the connection braces 44. Turn 43 forms a boundary for the capillary drawing-in. Dependent on the dimensions of the cathode filament, the number of turns 46 between turn 43 and braces 44 is chosen so that the spaces between turns 46 are entirely filled with the molten material. It is of course also possible instead of one turn 43 having a larger pitch to use a few turns having a larger pitch as a boundary for the capillary drawing-in.

When using the invention resistance differences between different filaments of only 0.8% are measured.

What is claimed is:

1. A cathode-ray tube comprising an evacuated envelope containing an electron gun for generating an electron beam, said electron gun including a cathode unit comprising a cup-shaped cathode shaft, a filament disposed within said shaft, and connection members to which ends of the filament are welded, said filament comprising a metal wire wound in the form of a first helical spiral which is wound into a second helical spiral having a larger diameter, characterized in that at least one of the first spiral's turns, near each end of the filament and spaced from the connection member to which the respective end of the filament is welded, is formed with a larger pitch than the other turns, and the turns of the first spiral located between the turn with the larger pitch and the respective connection member are filled with the material of the connection member.

2. A cathode-ray tube as in claim 1, characterized in that the thickness of the metal wire is approximately 25 μm, the pitch of the first spiral is between 40 and 50 μm, and the larger pitch is between 55 and 80 μm.

3. A cathode-ray tube as in claim 1, characterized in that the filament is connected to the connection means by laser welding.

4. A cathode-ray tube as in claim 1, characterized in that the tube is a television camera tube having a cathode filament power rating of 0.5 Watt.

5. A cathode unit for a cathode ray tube, said cathode unit comprising a cup-shaped cathode shaft, a filament disposed within said shaft, and a connection member to which ends of the filament are welded, said filament comprising a metal wire wound in the form of a first helical spiral which is wound into a second helical spiral having a larger diameter, characterized in that at least one of the first spiral's turns, near each end of the filament and spaced from the connection member to which the respective end of the filament is welded, is formed with a larger pitch than the other turns, and the turns of the first spiral located between the turn with the larger pitch and the respective connection member are filled with the material of the connection member.

* * * * *